US005970870A

United States Patent [19]

Shiba et al.

[11] Patent Number: 5,970,870

[45] Date of Patent: Oct. 26, 1999

[54] WEB-FED OFFSET PRINTING PRESS CAPABLE OF IMAGE CONVERSION WITHOUT WEB STOPPAGE

[75] Inventors: Noriyuki Shiba, Tokyo; Yoshinori Uera; Kazuyuki Motojima, both of Kanagawa; Hideo Kawamori, Tokyo, all of Japan

[73] Assignee: Kabushiki Kaisha Tokyo Kikai Seisakusho, Tokyo, Japan

[21] Appl. No.: 09/233,428

[22] Filed: Jan. 20, 1999

[30] Foreign Application Priority Data

Mar. 6, 1998 [JP] Japan ..... 10-054595

[51] Int. Cl.[6] ..... B41F 7/04; B41F 7/12

[52] U.S. Cl. ..... 101/137; 101/139; 101/177

[58] Field of Search ..... 101/177, 143, 101/218, 219, 217, 178–185, 221, 225, 247, 140, 141, 142–145, 136, 137, 139

[56] References Cited

U.S. PATENT DOCUMENTS

| | | | |
|---|---|---|---|
| 2,051,573 | 8/1936 | Quick et al. | 101/221 |
| 4,240,346 | 12/1980 | Landis et al. | 101/180 |
| 4,919,046 | 4/1990 | Kakko-Chiloff | 101/177 |
| 5,134,934 | 8/1992 | Knauer et al. | 101/143 |

FOREIGN PATENT DOCUMENTS

| | | |
|---|---|---|
| 8-197826 | 8/1996 | Japan . |
| 8-207233 | 8/1996 | Japan . |
| 9-314813 | 12/1997 | Japan . |

*Primary Examiner*—J. Reed Fisher
*Attorney, Agent, or Firm*—Nikaido Marmelstein Murray & Oram, LLP.

[57] ABSTRACT

An offset perfecting press is disclosed which has a pair of blanket cylinders on opposite sides of a web traveling along a predefined path. Bearing different images to be printed, two plate cylinders are disposed in circumferentially spaced apart positions on each blanket cylinder. Each plate cylinder is independently movable between an image transfer position, where the plate cylinder is held to the blanket cylinder in order to print an image thereon for subsequent transfer to the web, and an image nontransfer position where the plate cylinder is spaced from the blanket cylinder. Only one plate cylinder is held in the image transfer position on each side of the web. For a change from one image to another, the plate cylinders that have been printing the opposite sides of the web are retracted to the image nontransfer positions, and the other plate cylinders, rotating in phase with the blanket cylinders, are moved to the image transfer positions. There is no need for stopping the web or the blanket cylinders. An electronic control system is provided for automatic image conversion. A multiple-unit, multiple-tower, multiple-web rotary press is also disclosed which comprises a multiplicity of printing units, including one or more constructed as in the foregoing, which are arranged in multiple towers for concurrently printing multiple webs under automatic control.

15 Claims, 6 Drawing Sheets

WEB-FED OFFSET PRINTING PRESS CAPABLE OF IMAGE CONVERSION WITHOUT WEB STOPPAGE

BACKGROUND OF THE INVENTION

This invention relates to offset printing presses, and particularly to a web-fed offset printing unit capable of changing images to be printed on a web of paper or like material with the web kept running during such image changes, and to a printing machine incorporating a plurality of such units.

Japanese Unexamined Patent Publications Nos. 8-197826, 8-207233, and 9-314813 are hereby cited as teaching web-fed offset printing presses capable of changing printing images without stopping the web. The first cited prior art machine (8-197826) has a plurality of printing units in alignment along the path of the web, the printing units having the same or, different printing plates for printing one or both sides of the web. A required set of printing plates are first clamped around the plate cylinders of all the printing units. The printing units are selectively put to use for successively printing the images on the web in a required sequence. For each image change the plate cylinder or cylinders of the printing unit to be set out of operation are moved away from the associated blanket cylinder or cylinders, and the plate cylinder or cylinders of a desired printing unit that has been out of operation are actuated into contact with the associated blanket cylinder or cylinders for printing a new image on the web.

The second known printing press (8-207233) is analogous with the first cited machine in that a plurality of printing units are aligned along the web path and selectively used for printing different images on the continuously running web in a prescribed sequence. Only the blanket cylinder of the printing unit that has been in operation till an image change is moved out of contact with the web, and that of the unit having the next image to be printed is moved into contact with the running web.

This second reference discloses a variation featuring a blanket cylinder that is twice as long in circumference as each plate cylinder, in order that the different images on two different plate cylinders may be concurrently printed on the web through one and the same blanket cylinder.

In this variation, too, image changes are accomplished by selective use of the different printing units. The two plate cylinders of a printing unit to be put out of operation are moved out of contact with the blanket cylinder, and, in a printing unit that has been out of operation, the two plate cylinders bearing the new plates are jointly moved into contact with the blanket cylinder of that unit. A change is thus made concurrently from two images to two others. No plate cylinders are of course in contact with the blanket cylinder on the nonprinting side of the web.

The third mentioned reference discloses two modes of carrying out the invention. In one such mode two sets of a plate cylinder and a blanket cylinder are employed in conjunction with a single impression cylinder around which the web is threaded. A change from one set to the other, and hence from one image to the other, is achieved without stopping the web. This first mode also permits printing either directly from the plate cylinders or indirectly through the blanket cylinders. Therefore, for an image change, the blanket cylinder or the plate cylinder that has been in operation is moved away from the web, and the other blanket cylinder or plate cylinder is driven into printing engagement with the web.

The second mode of the third reference is directed to an offset perfecting press, comprising a plurality of printing units each having a pair of blanket cylinders on both sides of the web and a pair of plate cylinders each in contact with one blanket cylinder. An image conversion is accomplished upon retraction of the plate cylinders of one printing unit that has been in operation away from the blanket cylinders of that unit, followed by the movement of the plate cylinders of some other desired printing unit into contact with the blanket cylinders of that other printing unit. All the blanket cylinders are synchronously rotated from a common drive shaft.

In changing images by any of the methods set forth hereinbefore the peripheral speed of the plate cylinder, or of both plate cylinder and blanket cylinder, to be moved into printing engagement with the web must be preadjusted to the traveling speed of the web at the moment of image change. The aforementioned prior art machines are all equipped for such preadjustment.

All these conventional machines are objectionable, however, for more reasons than one. First of all, they are all alike in having a plurality of printing units, each comprising at least a blanket cylinder and one or two plate cylinders, aligned along the path of the web, with a required spacing from one unit to the next. Such units include not only those that must be put to joint operation for the printing job but an additional unit or units for image changes. The row of printing units have rendered the machines inordinately long in the traveling direction of the web, demanding large installation spaces and making the presses very expensive in construction.

The stacking of the multiple printing units would provide no fundamental solution to the problem in consideration of the excessive height of the resulting machine. Such a machine would, moreover, require labor at heights and so would be poor in operability, maintenance and management.

Another objection arises from the fact that the plate cylinder or cylinders are out of contact with the blanket cylinder in any printing unit that is out of operation. That blanket cylinder is not dampened during such time. Consequently, when any printing unit is set out of operation, a varied spacing has been created between those damping positions on the web where images are being offset printed from the, moistened blanket cylinders. The web has been susceptible to different degrees of lateral expansion, or fanout, as it traverses the successive printing units, resulting, in the case of a multiple printing press, in the nonregistration of an image that has been newly printed on the web and the images printed by the units lying upstream and downstream, respectively, of the newly printing unit. Large amounts of paper have been wasted because of such unregistered image production.

With the plate cylinder or cylinders kept out of contact with the blanket cylinder in any nonprinting unit as above, the unmoistened blanket may be left in contact with the web for an extended period of time. Thereupon, as is familiar to the printing engineers, large amounts of paper fibers and particles have frequently transferred from web to blanket. Additionally, if an image or images are being printed upstream of the nonprinting unit, the fresh ink on the web has been easy to stain and smear the nonprinting blanket. The ink has been prone to be retransferred from the blanket back to the web, out of place of course, to the detriment of the printing quality.

SUMMARY OF THE INVENTION

In consideration of the foregoing state of the art the present invention has it as an object to make conversion from one printing image to another possible in web-fed offset presses without need for the provision of an extra printing unit or units and hence to keep their space requirements at a minimum, either horizontally or vertically.

Another object of the invention is to eliminate variations in spacings between printed images due to image changes, thereby precluding the resulting irregular fanout of the web and the smearing or impairment of the blankets from the nonsupply of water.

A further object of the invention is to fully automate the process of image conversion.

A further object of the invention is to compactly combine a plurality of printing units, each constructed to accomplish the foregoing objects, together with or without other units of conventional make, into a streamlined printing machine capable of simultaneously printing a plurality of webs.

A yet further object of the invention is to synchronize the operations of all the printing units incorporated into a single machine as above.

Briefly, the present invention may be summarized as a web-fed offset printing press for printing at least one side of a web of paper or the like. The press comprises a blanket cylinder disposed at least on one side of a web traveling along a predefined path, and at least two plate cylinders disposed in circumferentially spaced apart positions of the blanket cylinder for offset printing different images on the web via the blanket cylinder. Different drive means are provided for rotating the blanket cylinder and each plate cylinder. The plate cylinders are not only rotatable but individually displaceable between an image transfer position, where each plate cylinder is held to the blanket cylinder in order to print an image thereon for subsequent transfer to the web, and an image nontransfer position where the plate cylinder is spaced from the blanket cylinder. Also included are control means for causing the blanket cylinder drive means and the plate cylinder drive means to rotate the blanket cylinder and each plate cylinder at the same peripheral speed, and for causing the plate cylinder displacement means to individually move the plate cylinders between the image transfer and the image nontransfer positions.

In use of the printing press constructed as in the foregoing, plates bearing different images to be printed are to be clamped around the two plate cylinders on one, or each, side of the web. A desired one of the plate cylinders may first be moved to the image transfer position for printing the desired image on the web. For image conversion this one plate cylinder may be retracted to the image nontransfer position, and the other plate cylinder moved from the image nontransfer to the transfer position, with the blanket cylinder and the plate cylinders held in rotation at the same peripheral speed during such image conversion. There is therefore no need for stopping the blanket cylinder or the web.

It should be appreciated that the invention requires no extra printing unit for image conversion. The printing press according to the invention is therefore drastically less in size and manufacturing cost than conventional makes that provide for image conversion without web stoppage.

The advantages accruing from the fact that the invention demands no extra printing unit for image conversion become even more pronounced in construction where a plurality of printing units are stacked up vertically for multiple printings on a web. Such a stack is remarkably less tall than the stacks of prior art units of like printing capabilities. The reduced height machines according to the invention are easier to operate, maintain, and supervise.

A further advantage of the invention is that the blanket cylinder on one, or each, side of the web remains in contact with the web throughout the printing operation and either one of the plate cylinders contacts with the same blanket cylinder though the image conversion is performed. Consequently, since a spacing between dampening positions is not varied, no change occurs in the fanout of the web due to the moistening water, causing no printing of the new image out of register with the images printed by the upstream and downstream units. The waste of paper due to such out-of-register printings, which has so far been more or less unavoidable, is now rendered avoidable, realizing substantial curtailment of running costs and saving of the material.

Numerous other advantages are gained by the invention over the noted prior art. First, the machine according to the invention is energy saving as it requires the movement of only one plate cylinder from the printing to the nonprinting position, and of only one other plate cylinder from the nonprinting to the printing position, for a change from one image to another.

Second, the plate cylinders which travel between the printing and the nonprinting positions for image conversion do not contact with and separate from the running web, and the blanket cylinder or cylinders are remaining in contact therewith during the printing operation including image conversion time. The web can thus be maintained under constant tension, precluding trouble that might arise from changes in web tension.

Third, the blanket cylinder or cylinders are not left in contact with the web for any extended period of time without being moistened from either plate cylinder because of image conversion. There is accordingly no impairment of the blanket cylinders due to the transfer of paper fabrics and particles, as well as ink, from the web, and no degradation of the printing quality due to the retransfer of the ink from the cylinders back to the web. The blankets will enjoy a much longer useful life, and the running cost of the machine will be lower, than heretofore.

The above and other objects, features and advantages of this invention will become more apparent, and the invention itself will best be understood, from a study of the following description and appended claims, with reference to the attached drawings showing some preferable embodiments of the invention.

DESCRIPTION OF THE PREFERRED EMBODIMENTS

Figure 1:
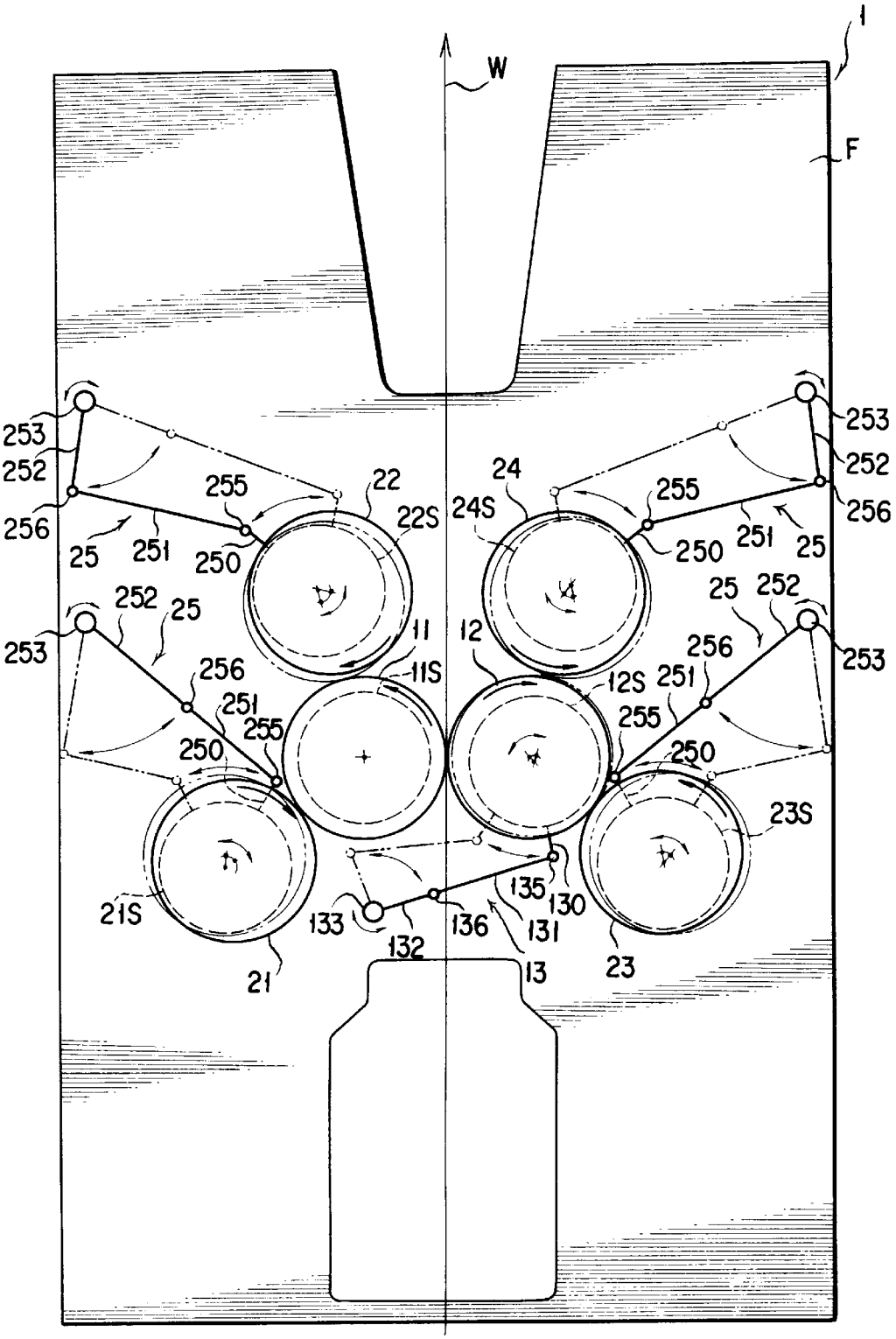
FIG. 1 is a diagrammatic end view of a web-fed, offset perfecting press embodying the principles of this invention, the view showing in particular the arrangement of blanket cylinders and plate cylinders together with means for moving one blanket cylinder into and out of engagement with the other, and the plate cylinders into and out of engagement with the blanket cylinders.

The present invention will now be described in detail as embodied in the web-fed, offset perfecting press illustrated in FIGS. 1–4. Generally designated 1 in FIG. 1, the exemplified press has two blanket cylinders 11 and 12 disposed on opposite sides of the predefined path of the web W, two plate cylinders 21 and 22 for printing against one blanket cylinder 11, and another two plate cylinders 23 and 24 for printing against the other blanket cylinder. 12. Images are transferred from the plates, not shown, that are clamped around the plate cylinders 21 and 22, or 23 and 24, to the blanket, not shown, around the blanket cylinder 11 or 12, and thence to the web W. The perfecting press thus dispenses with impression cylinders and, instead, employs the blanket-to-blanket method of printing both sides of the web.

Figure 3:
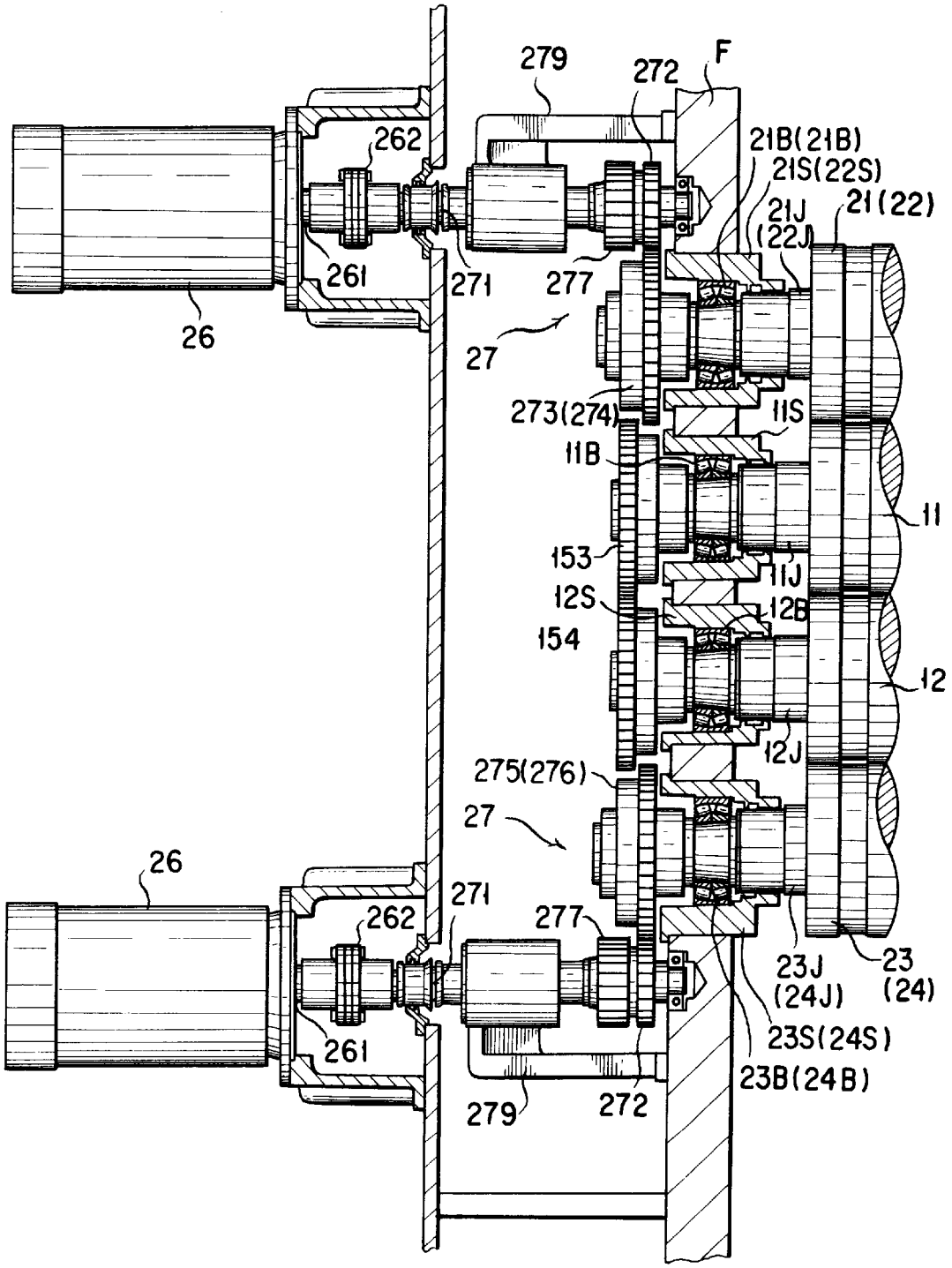
FIG. 3 is a fragmentary, developed section, partly shown in elevation for illustrative convenience, through the printing press of FIG. 1, showing in particular the drive means for rotating the plate cylinders and the means for rotatably supporting the blanket cylinders so as to permit one blanket cylinder to travel into and out of engagement with the other, and the plate cylinders so as to permit the same to individually move into and out of engagement with either of the blanket cylinders.
Figure 4:
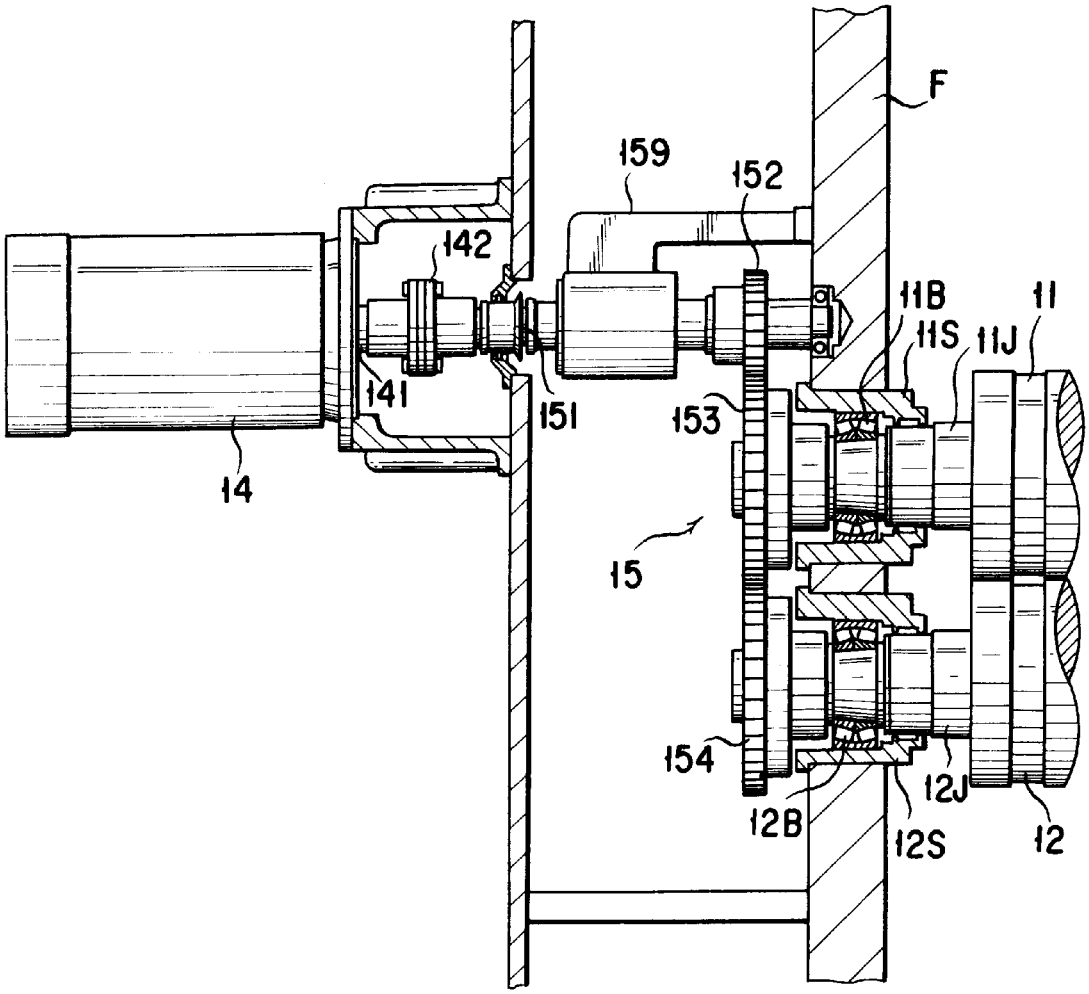
FIG. 4 is a fragmentary, developed section, partly shown in elevation for illustrative convenience, through the printing press of FIG. 1, showing in particular the drive means for jointly rotating the blanket cylinders.

Although the showings of FIGS. 3 and 4 are fragmentary, it will nevertheless be apparent that the blanket cylinders 11 and 12 are both rotatably supported by and between a pair of frame walls F, one seen, by having their journals 11J and 12J journaled in bearings 11B and 12B which in turn are mounted to the frame walls via sleeves 11S and 12S, respectively.

It should be noted that one of the blanket cylinders 11 and 12 is supported by the sleeves that are capable of rotary displacement relative to the frame walls F. That one blanket cylinder is the cylinder 12 in this particular embodiment of the invention.

A closer study of FIGS. 3 and 4 will reveal that although each journal 12J of the blanket cylinder 12 is concentrically journaled in the bearing 12B, this bearing and therefore the journal 12J are supported eccentrically by the rotary sleeve 12S. Consequently, with the bidirectional rotation, through a fairly small angle, of the pair of rotary sleeves 12S relative to the frame walls F, the blanket cylinder 12 is movable toward and away from the other blanket cylinder 11. The blanket cylinder 12 is thus capable of reciprocation between a printing position, where the blanket cylinder 12 is held against the other blanket cylinder 11 via the web W for printing both sides thereof, and a nonprinting position where the blanket cylinders are separated to release the web.

FIG. 1 shows an example of means for causing the bidirectional angular displacement of the sleeves 12S relative to the frame walls F and hence for moving the blanket cylinder 12 between the printing and the nonprinting positions. The exemplified means is a drive linkage 13 comprising a radial projection 130 on one of the sleeves 12S, a first link 131 having one end pivotally coupled to the sleeve projection 130, and a second link 132 having one end pivotally coupled to another end of the first link 131 and another end anchored to a bidirectional drive shaft 133.

Thus, with the bidirectional rotation of the drive shaft 133, the drive linkage 13 is movable between the solid-line and broken-line positions for causing the angular displacement of the sleeve 12S relative to the frame wall F. The drive linkage 13 is in the solid-line position when the blanket cylinder 12 is in the printing position, and in the broken-line position when the blanket cylinder is in the nonprinting position. Preferably, and as depicted in FIG. 1, the joint 135 between sleeve projection 130 and first link 131, the joint 136 between the links 131 and 132, and the axis of the drive shaft 133 should be in line when the drive linkage 13 is in the solid-line position, in order to positively hold the blanket cylinder 12 in the printing position.

Notwithstanding the showings of FIGS. 1, 3 and 4 it is understood that the other blanket cylinder 11 could be moved by like means between the printing and nonprinting positions, with the blanket cylinder 12 prevented from such movement. Or, as a further alternative, both blanket cylinders 11 and 12 could be driven toward and away from each other by like means.

At 14 in FIG. 4 is seen a drive motor for jointly rotating the blanket cylinders 11 and 12 via a gear train 15. The drive motor 14 has its output (armature) shaft 141 coaxially coupled at a coupling 142 to an extension shaft 151 which is rotatably supported by the frame wall F via a bracketed bearing 159. As seen also in FIG. 2, the gear train 15 comprises a drive pinion 152 mounted to the extension shaft 151 for joint rotation therewith, a first driven gear 153 mounted fast on the journal 11J of the first blanket cylinder 11 and meshing with the drive pinion 152, and a second driven gear 154 mounted fast on the journal 12J of the second blanket cylinder 11 and meshing with the first driven gear 153. The driven gears 153 and 154 are of the same diameter, so that the blanket cylinders 11 and 12 are driven at the same peripheral speed from the drive motor 14.

The second blanket cylinder 12 travels as aforesaid between the printing and nonprinting positions in this particular embodiment. The distance of such travel is understood to be less than the depth to which the teeth of the driven gears 153 and 154 intermesh when the second blanket cylinder 12 is in the printing position. Therefore, since the driven gears 153 and 154 do not completely disengage each other when the second blanket cylinder 12 travels to the nonprinting position, these driven gears are constrained to reestablish proper driving interengagement when the second blanket cylinder is subsequently forced back to the printing position.

With reference back to FIG. 1 the two plate cylinders 21 and 22 are provided in circumferentially spaced apart positions against the first blanket cylinder 11, and the other two plate cylinders 23 and 24 in circumferentially spaced apart positions against the second blanket cylinder 12. The two sets of one blanket cylinder 11 or 12 and two plate cylinders 21 and 22, or 23 and 24, are arranged in mirror-image relationship to each other as seen in an end view in FIG. 1.

Therefore, in FIG. 3, the blanket cylinders 11 and 12 are shown in combination each with only one plate cylinder which is assumed to represent the two plate cylinders associated with each blanket cylinder. Thus the representative plate cylinder associated with the first blanket cylinder 11 is designated 21(22), and the other representative plate cylinder associated with the second blanket cylinder 12 designated 23(24). A similar method of identification will be used in the following more detailed description of FIG. 3 to denote the parts related to the two representative plate cylinders 21(22) and 23(24).

The plate cylinders 21(22) and 23(24) have their journals 21J(22J) and 23J(24J) journaled in bearings 21B(22B) and 23B(24B) within eccentric sleeves 21S(22S) and 23S(24S) which in turn are rotatably mounted to the frame walls F. Like the sleeves 11S and 12S for the blanket cylinders 11 and 12, the sleeves 21S(22S) and 23S(24S) are capable of bidirectional angular displacement relative to the frame walls F in order to move the plate cylinders 21(22) and 23(24) into and out of rolling contact with the blanket cylinders 11 and 12, respectively. The plate cylinders 21(22) and 23(24) thus travel between an image transfer position, where they transfer the images from their plates to the blankets on the blanket cylinders 11 and 12 being held in the printing positions, and a nontransfer position where the plate cylinders are away from the blanket cylinders.

FIG. 1 illustrates four drive linkages 25 in this particular embodiment for individually causing the bidirectional angular displacement of the sleeves 21S–24S relative to the frame walls F and hence for moving the plate cylinders 21–24 between the image transfer and the nontransfer positions. Each of the four drive linkages 25, which are of like construction, comprises a radial projection 250 on one of the sleeves 21S–24S, a first link 151 having one end pivotally coupled to the sleeve projection 250, and a second link 252 having one end pivotally coupled to another end of the first link 251 and another end anchored to a bidirectional drive shaft 253.

Thus, with the bidirectional rotation of the drive shafts 253, the drive linkages 25 are individually movable between the solid-line and the broken-line positions for causing the angular displacement of the sleeves 21S–24S relative to the frame walls F, with the consequent travel of the plate cylinders 21–24 between the image transfer and the nontransfer positions. Preferably, as in the drive linkage 13 for the blanket cylinder 12, the links 251 and 252 of each drive linkage 25 should be in line when the associated plate cylinder 21, 22, 23 or 24 is in the image transfer positions. The solid lines in FIG. 1 indicate that the two plate cylinders 21 and 23 are in the image transfer positions, and the other two 22 and 24 in the nontransfer position. The drive linkages for the plate cylinders 21 and 23 are therefore shown aligned by the solid lines, and those for the plate cylinders 22 and 24 are not.

Figure 2:
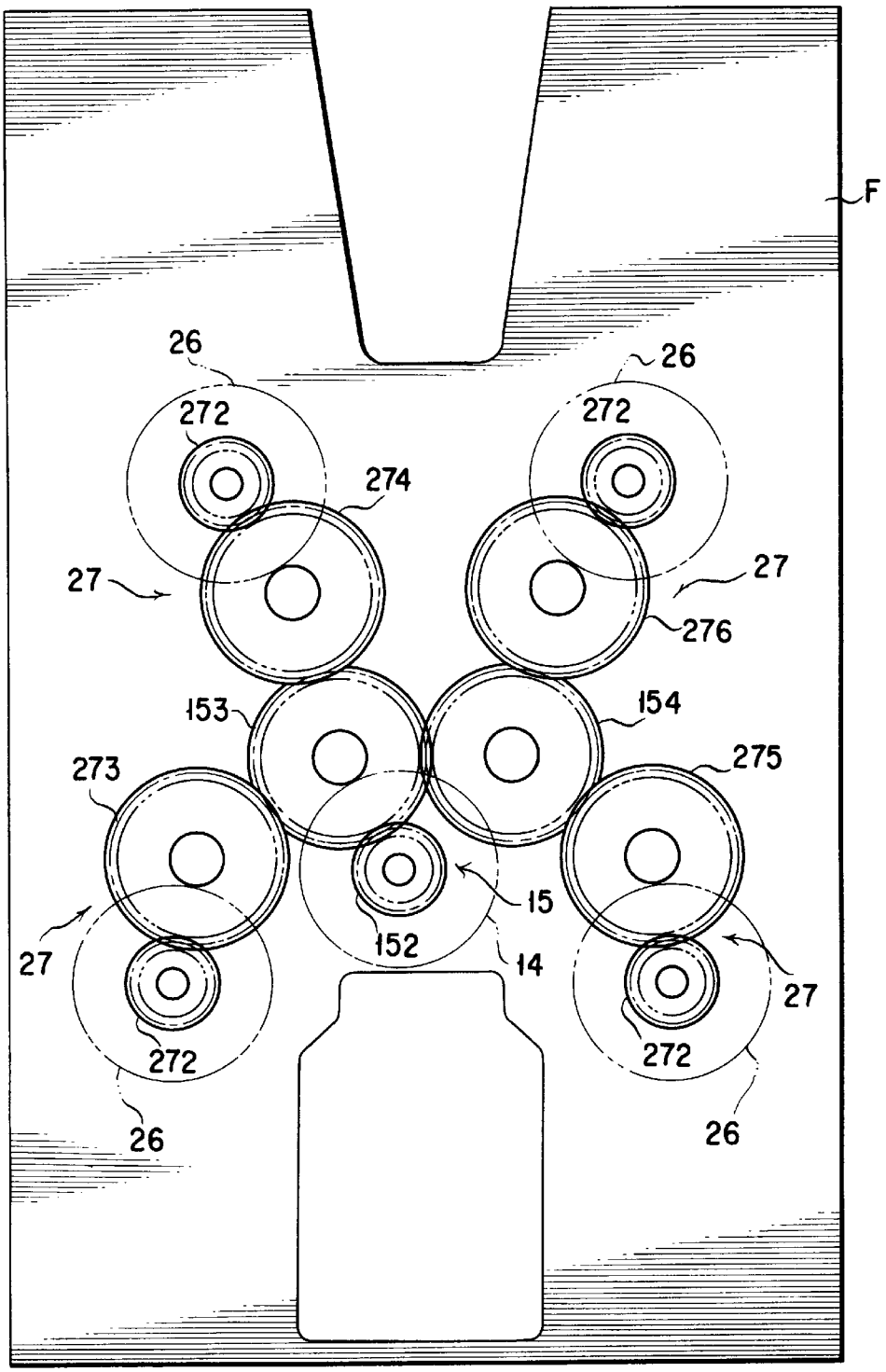
FIG. 2 is a diagrammatic end view of the printing press somewhat similar to FIG. 1 but showing in particular the drive means for jointly rotating the blanket cylinders and the drive means for individually rotating the plate cylinders.

FIG. 2 indicates four electric drive motors 26 for independently driving the four plate cylinders 21–24 via separate gear trains 27. As better illustrated in FIG. 3, which reveals only the two representative plate cylinders 21(22) and 23(24) as aforesaid, each drive motor 26 has its armature shaft 261 coaxially coupled at a coupling 262 to an extension shaft 271 which is rotatably supported by the frame wall F via a bracketed bearing 279. Mounted fast on the extension shaft 271, a drive pinion 272 meshes with a driven gear 273, 274, 275 or 276 on the journal 21J, 22J, 23J or 24J of the plate cylinder 21, 22, 23 or 24. (Another drive gear 277 shown mounted on each extension shaft 271 is for driving the inking and dampening mechanisms of the printing press which are not shown because they fall outside the purview of the instant invention).

Incidentally, in FIG. 2, it may appear as if the blanket cylinder gear 153 were in mesh with the plate cylinder gears 273 and 274, and the other blanket cylinder gear 154 with the other plate cylinder gears 275 and 276. Actually, they are not. As clearly pictured in FIG. 3, the blanket cylinder gears 153 and 154 and the plate cylinder gears 273–276 are axially offset from each other a sufficient distance to avert mutual interference.

Also, in FIG. 1, it is understood that the travel of the blanket cylinder 12 between the printing and nonprinting positions is controlled in relation to whether the plate cylinders 23 and 24 are in the image transfer or nontransfer position. For example, when the blanket cylinder 12 is to be retracted to the nonprinting position, both plate cylinders 23 and 24 must be in the nontransfer position.

Such being the improved construction of the offset printing press embodying the principles of the invention, printing images are changeable by alternate use of the plate cylinders 21 and 22 on one side of the web, and of the plate cylinders 23 and 24 on the other side of the web, without stopping the web or even the blanket cylinders. Plates bearing different images may therefore be mounted to the plate cylinders 21 and 22 and to the plate cylinders 23 and 24. One of the plate cylinders 21 and 22, and one of the plate cylinders 23 and 24, may be actuated to the image transfer positions against the blanket cylinders 11 and 12 for offset printing the opposite sides of the web via the blanket cylinders rotating in the printing positions. Conversion from the images now being printed to those standing by is accomplished simply as the other of the plate cylinders 21 and 22, and the other of the plate cylinders 23 and 24, are both driven to the image transfer positions immediately following the retraction of the first recited plate cylinders to the nontransfer positions, with the blanket cylinders held in rotation in the printing positions.

Figure 5:
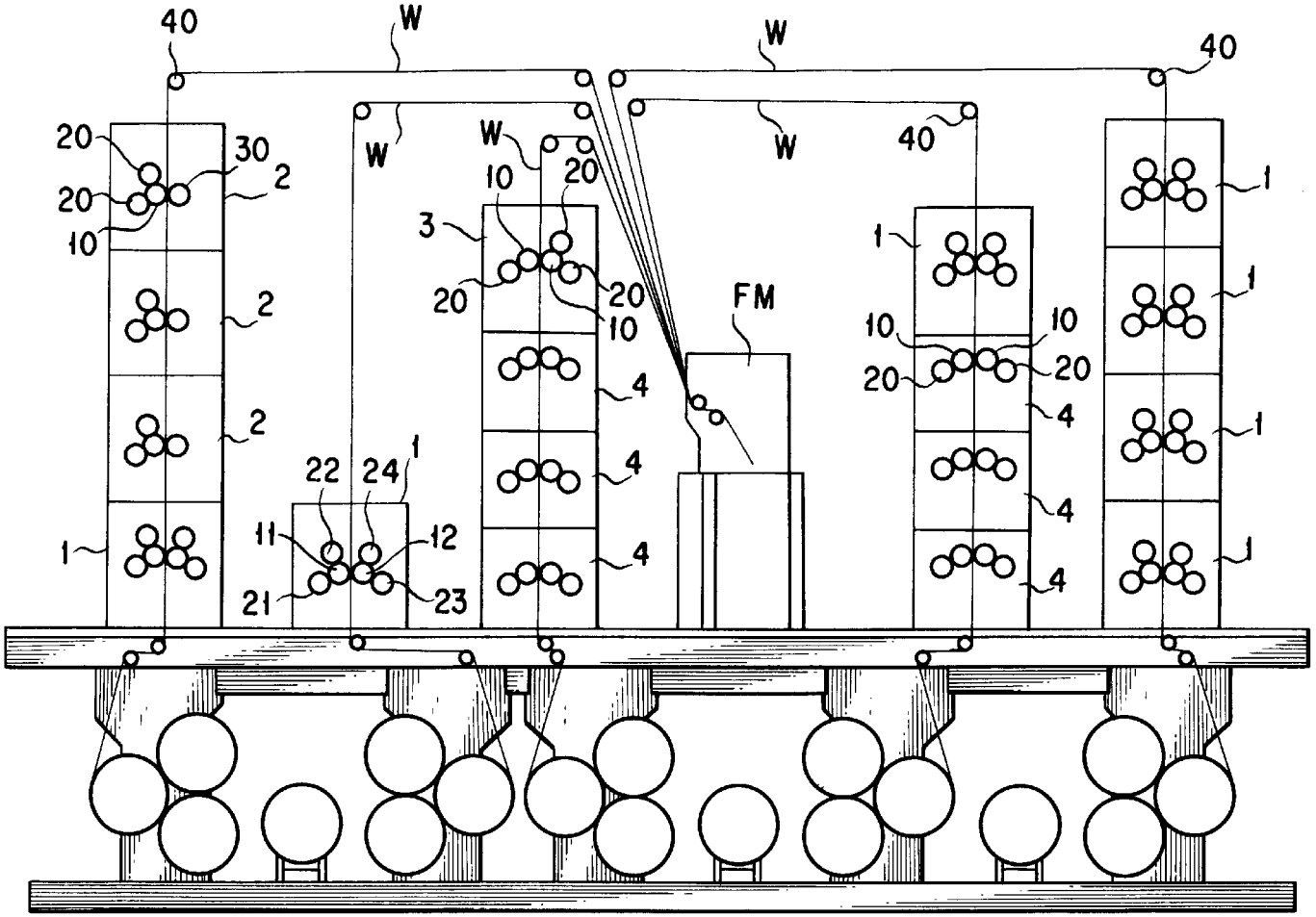
FIG. 5 is a schematic illustration of a multiple-printing-unit, multiple-tower, multiple-web rotary press incorporating a multiplicity of printing units arranged in multiple towers for concurrently printing multiple webs, some of the printing units embodying the principles of this invention and others not.

Diagrammatically illustrated in FIG. 5 is a multiple-unit, multiple-tower, multiple-web offset rotary press incorporating a plurality of, seven in the illustrated machine, printing units 1 according to the invention, each constructed as set forth hereinabove. Additionally, the machine is shown to comprise three second type printing units 2, one third type printing unit 3, and six fourth type printing units 4. All the printing units 1–4 are configured in five printing presses for printing a total of five webs W. Such printing presses consist of, from left to right in FIG. 5, a first printing press (tower) of one first type printing unit 1 at the bottom and three second type printing units 2, a second printing press of only one first type printing unit 1, a third printing press (tower) of three fourth type printing units 4 and one third type printing unit 3 at the top, a fourth printing press (tower) of three fourth type printing units 4 and one first type printing unit 1 at the top, and a fifth printing press (tower) of four first type printing units 1. The webs W are threaded one through each of these printing presses and all directed by guide rolls 40 into a folding device FM of any known or suitable make which gives them their down-the-middle fold.

Each second type printing unit 2 has one blanket cylinder 10, two plate cylinders 20 disposed in circumferentially spaced positions of the blanket cylinder, and an impression cylinder 30 lying opposite the blanket cylinder across the web path. The blanket cylinder 10 is movable into and out of contact with the impression cylinder 30 via the web W, just as the blanket cylinder 12 of the printing units 1 is with the other blanket cylinder 11. The plate cylinders 20 are individually movable into and out of contact with the blanket cylinder 10 the same way as the plate cylinders 21–24 of the printing units 1 are with the blanket cylinders 11 and 12. Thus the second type of printing units 2 may be considered a modification of the printing unit 1 for printing one side of a web.

The third type printing unit 3 has two blanket cylinders 10 disposed opposite each other across the web path, one plate cylinder 20 movable into and out of contact with one of the blanket cylinders, and two other plate cylinders 20 individually movable into and out of contact with the other blanket cylinder. The two plate cylinders 20 alternately printing via the single blanket cylinder are in accord with the fundamental concepts of this invention.

The fourth type printing units 4 are conventional in design, each comprising one plate cylinder movable into and out of contact with one blanket cylinder on each side of the web.

Figure 6:
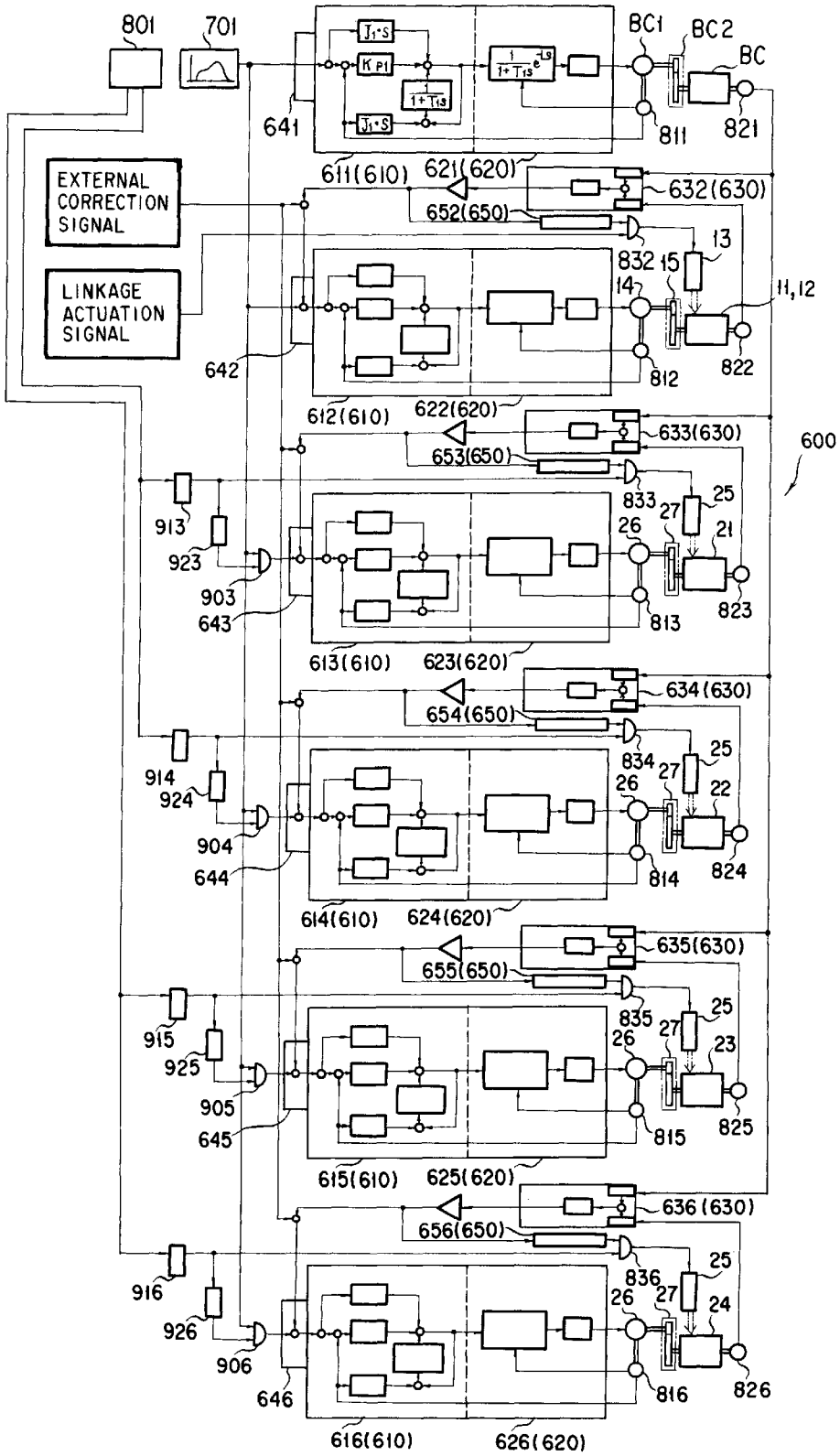
FIG. 6 is an electrical block diagram of the system for automatically controlling a representative one of the printing units of the FIG. 5 rotary press, the representative printing unit being constructed as shown in FIGS. 1–4.

FIG. 6 shows an example of electronic control system 600 for automatic control of each printing unit 1 in the multiple-unit, multiple-web rotary press of FIG. 5. In this control system 600 some suitable cylinder (e.g. folding cylinder) of the folding device FM is used as reference cylinder BC, and the rotations of the blanket cylinders 11 and 12 and plate cylinders 21–24 of each printing unit 1 are controlled so as to maintain them in predetermined phase relation with that of the reference cylinder BC. Maintaining the rotations of the blanket cylinders 11 and 12 and plate cylinders 21 and 24 in predetermined phase relation with that of the reference cylinder BC is tantamount to matching the peripheral speeds of all these cylinders as the blanket cylinders and the plate cylinders rotate in or out of rolling contact with each other.

More specifically, the control system 600 comprises a plurality of, six in the illustrated embodiment, serial connections of a modern control circuit (speed control circuit) 610 and an inverter circuit 620 for individually controlling a drive motor $BC_1$ for the reference cylinder BC, the common drive motor 14, FIG. 4, for the blanket cylinders 11 and 12, and the individual drive motors 26, FIGS. 2 and 3, for the four plate cylinders 21–24. (In FIG. 6 the reference numerals generally designating a plurality of circuits or other components, such as 610 and 620, are shown bracketed and preceded by numerals individually denoting the circuits or other components under the general designations.)

The control system 600 also comprises a plurality of phase difference detector circuits 630 for individually ascertaining the phase relations of the blanket cylinders 11 and 12 and plate cylinders 21–24 with respect to the reference cylinder BC. The phase difference detector circuits 630 include the one, individually labeled 632, for both blanket cylinders 11 and 12, rather than for each of these cylinders, because they are directly coupled to each other via the intermeshing gears 153 and 154, FIG. 3, and so bound to rotate in phase.

Also included in the control system 600 are a plurality of phase matching confirmation circuits 650, which includes the one, designated 652, designed to permit actuation of the drive linkage 13, FIG. 1, only when the blanket cylinders 11 and 12 are rotating in predetermined phase relation with the reference cylinder BC. The other phase matching confirmation circuits 653, 654, 655 and 656 are designed to permit the drive linkages 25 to be individually actuated only when the corresponding plate cylinder 21, 22, 23 or 24 is rotating in predetermined phase relation with the reference cylinder BC.

At 701 in FIG. 6 is seen a speed command circuit forming a part of sequential control means included in the control system 600, the other components of the sequential control means being not shown because of their impertinence to the instant invention. When the FIG. 5 printing machine is electrically turned on, the speed command circuit 701 will respond by producing a speed command signal for accelerating the various drive motors of the machine to the normal printing speed.

Concurrently, the drive linkage 13 will be actuated at a predetermined moment to move the blanket cylinder 12 from the nonprinting to the printing position against the other blanket cylinder 11. Also, either before or at an appropriate moment after the production of the printing start signal, a plate select circuit 801 will produce signals specifying either of the plate cylinders 21 and 22, and either of the plate cylinders 23 and 24, to be put to printing, that is, to be driven from the image nontransfer to the transfer positions against the blanket cylinders 11 and 12.

The speed command signal from the circuit 701 will be applied via the digital controller 641 to the modern control circuit 611 and thence to the inverter circuit 621 for causing the rotation of the drive motor $BC_1$ for the reference cylinder BC. The rotation of the drive motor $BC_1$ will be transmitted to the reference cylinder BC via gearing $BC_2$.

The reference cylinder motor $BC_1$, as well as the blanket cylinder motor 14 and plate cylinder motors 26, is equipped with means 811 for producing a series of motor speed pulses indicative of the speed of rotation of that motor. Inputting these motor speed pulses, the modern control circuit 611 and inverter circuit 621 will operate to cause rotation of the reference cylinder motor $BC_1$ at the specified speed through the feedback control loop. With such controlled speed rotation of the motor $BC_1$ and hence of the reference cylinder BC, all the webs of paper W to be printed upon will travel along their predefined paths at the matching speed.

The reference cylinder BC, as well as the blanket cylinders 11 and 12 and plate cylinders 21–24, is equipped with means 821 for production of a phase signal indicative of the rotational phase of the reference cylinder. The phase signal from the reference cylinder BC is supplied to the phase difference detector circuit 632 of the blanket cylinders 11 and 12 and to the phase difference detector circuits 633, 634, 635 and 636 of the plate cylinders 21–24.

The speed command signal from the circuit 701 is also delivered via another digital controller 642 to the modern control circuit 612 and hence to the inverter circuit 622 for causing the drive motor 14 for both blanket cylinders 11 and 12 to rotate at the predetermined speed. The rotation of the motor 14 will be imparted to the blanket cylinders 11 and 12 via the gearing 15 shown in detail in FIG. 4.

With the rotation of the blanket cylinder motor 14 the motor speed pulses indicative of its rotational speed will be applied from the means 812 to both speed control circuit 612 and inverter circuit 622. These circuits 612 and 622 will utilize the incoming motor speed pulses to maintain the rotation of the motor 14, and hence of the blanket cylinders 11 and 12, at the printing speed.

As the blanket cylinders 11 and 12 are thus set into rotation, the phase signal representative of the phase of their rotation will be applied from the means 822 to the phase difference detector circuit 632. Comparing this phase signal with that for the reference cylinder BC, the detector circuit 632 will put out a phase difference signal indicative of a phase difference, if any, between reference cylinder BC and blanket cylinders 11 and 12. The phase difference signal will be directed to the digital controller 642 after being combined with an external correction signal as required. The digital controller 642 will amend the speed command signal from the circuit 701 by the phase difference signal in order to maintain the rotation of the blanket cylinders 11 and 12 in predetermined phase relation with that of the reference cylinder BC.

The phase difference signal indicative of the phase difference between reference cylinder BC and blanket cylinders 11 and 12 will be also supplied to the phase matching confirmation circuit 652. This circuit will deliver an enabling signal to one input of the AND gate 832 when the phase difference signal indicates that the rotations of the reference cylinder BC and blanket cylinders 11 and 12 are in predetermined phase relation. Supplied to the other input of the AND gate 832 is a binary linkage actuation signal from the aforesaid sequential control means. When the linkage actuation signal is high and, at the same time, the blanket cylinders 11 and 12 are rotating in predetermined phase relation with the reference cylinder BC, is the AND gate 832 enabled to actuate the drive linkage 13. Thereupon the blanket cylinder 12 will travel into rolling contact with the other blanket cylinder 11 via the web W, with both blanket cylinders rotating at the same peripheral speed, and the web running at the matching speed.

The noted speed command signal from the circuit 701 is further applied through AND gates 903, 904, 905 and 906 to digital controllers 643, 644, 645 and 646 and thence to modern control circuits 613, 614, 615 and 616 and inverter circuits 623, 624, 625 and 626, for causing rotation of the four drive motors 26, two shown in FIG. 3 and all four in phantom outline in FIG. 2, for the individual plate cylinders 21–24. All the plate cylinder motors 26 are not put to simultaneous rotation, however, but only two on the opposite sides of the web W are.

For such selective rotation of the plate cylinder motors 26, the aforesaid plate select circuit 801 is connected to the other inputs of the AND gates 903–906 via respective flip flop circuits 913, 914, 915 and 916 and delay circuits 923, 924, 925 and 926. The flip flop circuits 913–916 will go high or low according to the plate select signals from the circuit 801, enabling or disabling the associated AND gates 903–906.

Let use assume that the two plate cylinders 21 and 23, each on one side of the web W as in FIG. 1, have now been chosen for printing the opposite sides of the web. The flip flop circuits 913 and 915 will then go high, and the flip flop circuits 914 and 916 low, in response to the plate select signals from the circuit 801. The AND gates 903 and 905 will be enabled in the presence of the speed command signal from the circuit 701, with the result that two of the motors 26 for the plate cylinders 21 and 23 are set into rotation for driving these plate cylinders via the gearings 27, FIG. 3.

Just as the blanket cylinder motor 14 is provided with the means 812 for generating the blanket cylinder motor speed pulses, so are the plate cylinder motors 26 with means 813, 814, 815 and 816 for production of motor speed pulses indicative of the speeds of rotation of the individual plate cylinder motors. Since the two motors for the plate cylinders 21 and 23 are now assumed to be in rotation, the motor speed pulses from these two motors will be input to the two associated modern control circuits 613 and 615 and inverter circuits 623 and 625, which will then conventionally function to maintain the rotation of the two motors 26, and hence of the plate cylinders 21 and 23, at the required image transfer speed.

Also like the reference cylinder BC and blanket cylinders 11 and 12, the plate cylinders 21–24 are furnished with means 823, 824, 825 and 826 for production of phase signals indicative of the rotational phases of the plate cylinders. The phase signals from the two plate cylinders 21 and 23 now in rotation will be directed into the phase difference detector circuits 633 and 635, to which there is also supplied as aforesaid the phase signal from the reference cylinder BC. Comparing the two incoming phase signals, each of the phase difference detector circuits 633 and 635 will produce a phase difference signal indicative of a phase difference, if any, between the reference cylinder BS and the corresponding one of the plate cylinders 21 and 23.

Combined with an external correction signal as required, the phase difference signals from the circuits 633 and 635 will be applied to the digital controllers 643 and 645, respectively. The digital controllers 643 and 645 will amend the speed command signals from the circuit 701 by the phase difference signals, and the amended speed command signals will be directed into the speed control circuits 613 and 615 and inverter circuits 623 and 625 for driving the two plate cylinder motors 26 so as to maintain the rotation of the plate cylinders 21 and 23 in predetermined phase relation with that of the reference cylinder BC.

The phase difference signals indicative of the phase differences between reference cylinder BC and plate cylinders 21 and 23 will be also applied to phase matching confirmation circuits 653 and 655. These circuits will deliver enabling signals to respective AND gates 833 and 835 when the phase difference signals indicate that the rotations of the reference cylinder BC and the plate cylinders 21 and 23 are in predetermined phase relation, respectively.

Supplied to the other input of the AND gate 833 and 835 are the plate select signals from the flip flop circuits 913 and 915. When the plate cylinders 21 and 23 are rotating in predetermined phase relation with the reference cylinder BC, and the plate select signals for the plate cylinders 21 and 23 are both high, as assumed to be the case now, the AND gates 833 and 835 will be enabled to actuate the two drive linkages in question. Thereupon the plate cylinders 21 and 23, will travel from the broken line nontransfer position to the solid-line transfer position of FIG. 1, making smooth rolling engagement with the blanket cylinders 11 and 12 rotating in the printing positions since the plate cylinders are now in rotation in predetermined phase relation with the reference cylinder BC and therefore with the blanket cylinders.

The images on the plates around the two plate cylinders 21 and 23 will now be printed on the blankets around the blanket cylinders 11 and 12, respectively, from which the images will be transferred or offset to the opposite surfaces of the web W by pressure applied to the web by both blanket cylinders.

The present invention permits ready conversion from the images on the plate cylinders 21 and 23 to those on the other plate cylinders 22 and 24 without stopping the web W or the blanket cylinders 11 and 12. For such conversion the operator or supervisor may simply re-specify the plate cylinders 22 and 24 on the plate select circuit 801, canceling the previous specifications of the plate cylinders 21 and 23. Thereupon the flip flop circuits 913 and 915 will go low, and the flip flop circuits 914 and 916 go high.

The resulting low inputs to the AND gates 833 and 835 will disable them in the face of continued application thereto of high outputs from the phase matching confirmation circuits 653 and 655. Thereupon the drive linkages 25 for the plate cylinders 21 and 23 will contract from their solid-line extended positions of FIG. 1 to the broken-line folded positions. Both plate cylinders 21 and 23 will then move out of printing engagement with the blanket cylinders 11 and 12, while being still maintained in rotation in phase with these blanket cylinders, and retract to their broken-line image nontransfer positions.

After being delayed a prescribed length of time by the delay circuits 923 and 925, the low outputs from the flip flop circuits 913 and 915 will be also applied to the AND gates 903 and 905 thereby nullifying the speed commands to the digital controllers 643 and 645. The drive motors 26 for the plate cylinders 21 and 23 will therefore be decelerated and stopped after these plate cylinders have retracted to their image nontransfer positions as above.

The high outputs from the flip flop circuits 914 and 916, on the other hand, will enable the AND gates 904 and 906 to put out the speed command signals. The speed command signals will be directed through the digital controllers 644 and 646 to the modern control circuits 614 and 616 and inverter circuits 624 and 626 for driving those two of the motors 26 which are for the plate cylinders 22 and 24. These plate cylinders 22 and 24 will then be set into rotation in their solid-line image nontransfer positions of FIG. 1.

With the rotation of the two plate cylinder motors 26 in question, the means 814 and 816 provided to these motors will put out series of motor speed pulses representative of their speeds of rotation. The modern control circuits 614 and 616 and inverter circuits 624 and 626 will utilize the motor speed pulses to cause the plate cylinder motors 26 to rotate constantly at the required printing speed.

Also, with the rotation of the plate cylinders 22 and 24, the phase signals will be produced which represent the rotational phases of these plate cylinders. These phase signals will be directed into the phase difference detector circuits 634 and, 636, to which there is also supplied the phase signal from the reference cylinder BC. Comparing the two incoming phase signals, each phase difference detector circuit 634 or 636 will produce a phase difference signal indicative of a phase difference, if any, between reference cylinder BS and plate cylinder 22 or 24. The digital controllers 644 and 646 will amend the speed command signals from the circuit 701 by the phase difference signals, and the amended speed command signals will be directed into the speed control circuits 614 and 616 and inverter circuits 624 and 626 for driving the two plate cylinder motors 26 so as to maintain the rotation of the plate cylinders 24 and 26 in predetermined phase relation with that of the reference cylinder BC.

The phase difference signals between reference cylinder BS and plate cylinders 22 and 24 will be also directed into phase matching confirmation circuits 654 and 656. These circuits will supply enabling signals to AND gates 834 and 836 when the phase difference signals indicate that the rotations of the reference cylinder BC and the plate cylinders 22 and 24 are in predetermined phase relation, respectively.

As has been mentioned, the flip flop circuits 914 and 916 have gone high upon selection of the plate cylinders 22 and 24 on the plate select circuit 801 for image conversion from the plate cylinders 21 and 23. Inputting these high outputs from the flip flop circuits 914 and 916, the AND gates 834 and 836 will be enabled to produce signals for causing actuation of those two of the drive linkages 25 for the plate cylinders 22 and 24. Thereupon, rotating in predetermined phase relation with the reference cylinder BC, the plate cylinders 22 and 24 will travel to the image transfer positions against the blanket cylinders 11 and 12 which have been in continued rotation in predetermined phase relation with the reference cylinder and hence with the plate cylinders 22 and 24.

Now has been completed the conversion of images from those on the plate cylinders 21 and 23 to those on the plate cylinders 22 and 24. The complete machine of FIG. 5 has been in continuous operation throughout the process of such image conversion.

As has been mentioned in the course of the foregoing description of operation that all the blanket cylinders 11 and 12 and plate cylinders 21–24 of the representative printing unit 1 are controlled and maintained in predetermined phase relation with a cylinder of the folding device FM. It is understood that the blanket cylinders and plate cylinders, as well as impression cylinders, of all the other printing units 1–4 of the FIG. 5 machine are likewise phased with the same cylinder of the folding device. In this manner the printing of all the webs W will proceed synchronously at the five printing towers, before they are guided altogether into the folding device FM.

The use of a folding device cylinder as reference cylinder is by way of example only, however. Alternatively, for example, a blanket cylinder of any printing unit may be adopted for the same purpose.

The foregoing operational description has been limited to the offset perfecting press units 1 of the FIG. 5 machine. It will be self-evident, then, that image conversion is possible by substantially the same means and the same method as above in the printing units 2 and 3, too, which have two plate cylinders against one blanket cylinder on either side of the web. Furthermore, in all the printing units 1–4 of FIG. 5, the blanket cylinders, plate cylinders, and impression cylinders might be driven by separate means.

In the practice of the invention the need may arise for replacing the plates on the plate cylinders that have been retracted away from the blanket cylinders. It is considered apparent for the printing specialists to devise means for controlling such replacement of printing plates without interrupting the printing operation.

Although the offset printing press according to this invention has been shown and described hereinabove in terms of some preferred forms thereof, it is not desired that the invention be limited to the exact details of such specific forms. Various modifications and alterations thereof may be resorted to without departing from the fair meaning or proper scope of the invention as expressed in the attached claims.

What is claimed is:

1. A web-fed offset printing press for printing at least one side of a web of paper material, comprising:

(a) a blanket cylinder disposed at least on one side of a web traveling along a predefined path;

(b) blanket cylinder drive means for rotating the blanket cylinder, wherein the blanket cylinder drive means comprises a blanket cylinder drive motor;

(c) at least two plate cylinders disposed in circumferentially spaced positions of the blanket cylinder for offset printing different images on the web;

(d) plate cylinder drive means for individually rotating each plate cylinder, wherein the plate cylinder drive means comprises a plate cylinder drive motor for each plate cylinder;

(e) displacement means for individually moving each plate cylinder between an image transfer position, where the plate cylinder is held to the blanket cylinder in order to print an image thereon for subsequent transfer to the web, and an image nontransfer position where the plate cylinder is spaced from the blanket cylinder; and (f) control means for causing the blanket cylinder drive means and the plate cylinder drive means to rotate the blanket cylinder and each plate cylinder at the same peripheral speed, and for causing the displacement means to individually move the plate cylinders between the image transfer and the image nontransfer positions, wherein the control means comprises:

(1) modern control circuit means connected to each of the blanket cylinder drive motor and the plate cylinder drive motors for independently controlling the speed of rotation thereof, (2) phase signal means for producing a phase signal indicative of the rotational phase of each of the blanket cylinder and the plate cylinders, (3) phase difference detector circuit means connected to the phase signal means for producing a phase difference signal indicative of a phase difference, if any, between the blanket cylinder and each plate cylinder, the phase difference detector circuit means being connected to the modern control circuit means for causing the rotation of the blanket cylinder and each plate cylinder in phase with each other, and (4) phase matching confirmation circuit means connected between the phase difference detector circuit means and the displacement means for each plate cylinder for permitting each plate cylinder to travel to the image transfer position only when that plate cylinder is rotating in phase with the blanket cylinder;

(g) whereby a conversion from one image to another is possible without stopping the blanket cylinder, as one plate cylinder is moved from the image transfer to the image nontransfer position and another plate cylinder is moved from the image nontransfer to the transfer position, with the blanket cylinder and the plate cylinders held in rotation at the same peripheral speed during such image conversion.

2. The web-fed offset printing press of claim 1 further comprising:

(a) a pair of frame walls;

(b) a plurality of sleeves rotatably mounted to each frame wall and each having a hole extending eccentrically therethrough; and (c) a pair of journals extending from opposite ends of each plate cylinder and each rotatably engaged in the eccentric hole of one of the sleeves;

(d) whereby each plate cylinder is moved between the image transfer and the image nontransfer positions with the bidirectional rotation of the associated pair of sleeves relative to the frame walls through a preassigned angle.

3. The web-fed offset printing press of claim 2 wherein the displacement means comprises:

(a) a plurality of drive shafts independently capable of bidirectional rotation; and (b) at least two articulated links connecting each drive shaft to one of the sleeves.

4. The web-fed offset printing press of claim 1 wherein the blanket cylinder is disposed only on one side of the web, there being an impression cylinder on the other side of the web.

5. The web-fed offset printing press of claim 1 wherein the blanket cylinder is disposed on each side of the web, with at least two plate cylinders for alternately printing one side of the web via one blanket cylinder, and at least one plate cylinder for printing the other side of the web via the other blanket cylinder.

6. A web-fed offset perfecting printing press for printing both sides of a web of paper material, comprising:

(a) two blanket cylinders disposed on opposite sides of a web traveling along a predefined path;

(b) blanket cylinder drive means for rotating the blanket cylinders at the same peripheral speed, wherein the blanket cylinder drive means comprises a single blanket cylinder drive motor for jointly driving both blanket cylinders;

(c) blanket cylinder displacement means for moving one blanket cylinder between a printing position, where said one blanket cylinder is held to the other blanket cylinder via the web for printing the same, and a nonprinting position where said one blanket cylinder is spaced from the other blanket cylinder;

(d) at least two plate cylinders disposed in circumferentially spaced positions of one blanket cylinder for offset printing different images on one side of the web;

(e) at least two other plate cylinders disposed in circumferentially spaced positions of the other blanket cylinder for offset printing different images on the other side of the web;

(f) plate cylinder drive means for individually rotating each plate cylinder, wherein the plate cylinder drive means comprises a plurality of plate cylinder drive motors each for driving one plate cylinder;

(g) plate cylinder displacement means for individually moving each plate cylinder between an image transfer position, where the plate cylinder is held against one blanket cylinder in order to print an image thereon for subsequent transfer to the web, and an image nontransfer position where the plate cylinder is spaced from the blanket cylinder; and (h) control means for causing the blanket cylinder drive means and the plate cylinder drive means to rotate the blanket cylinders and the plate cylinders at the same peripheral speed, and for causing the plate cylinder displacement means to individually move the plate cylinders between the image transfer and the image nontransfer positions, wherein the control means comprises:

(1) modern control circuit means connected to each of the blanket cylinder drive motor and the plate cylinder drive motors for independently controlling the speed of rotation thereof, (2) phase signal means for producing a phase signal indicative of the rotational phase of the blanket cylinders and each of the plate cylinders, (3) phase difference detector circuit means connected to the phase signal means for producing a phase difference signal indicative of a phase difference, if any, between the blanket cylinders and each plate cylinder, the phase difference detector circuit means being connected to the modern control circuit means for causing the rotation of the blanket cylinders and each plate cylinder in phase with each other, and (4) phase matching confirmation circuit means connected between the phase difference detector circuit means and the plate cylinder displacement means for each plate cylinder for permitting each plate cylinder to travel to the image transfer position only when that plate cylinder is rotating in phase with the blanket cylinder;

(i) whereby a conversion from one image to another is possible on each side of the web without stopping the blanket cylinders and with said one blanket cylinder held in the printing position, as one plate cylinder is moved from the image transfer to the image nontransfer position and another plate cylinder is moved from the image nontransfer to the transfer position, with the blanket cylinders and the plate cylinders held in rotation at the same peripheral speed during such image conversion.

7. The web-fed offset perfecting printing press of claim 6 wherein the blanket cylinder drive means comprises:

(a) a drive motor; and (b) a gear train through which the blanket cylinders are driven from the drive motor, the gear train including two intermeshing gears coupled coaxially one to each blanket cylinder for joint rotation therewith.

8. The web-fed offset perfecting printing press of claim 6 further comprising:

(a) a pair of frame walls;

(b) a pair of sleeves rotatably mounted one to each frame wall and each having a hole extending eccentrically therethrough; and (c) a pair of journals extending from opposite ends of said one blanket cylinder and each rotatably engaged in the eccentric hole of one of the sleeves;

(d) whereby said one blanket cylinder is moved between the printing and the nonprinting positions with the bidirectional rotation of the pair of sleeves relative to the frame walls through a preassigned angle.

9. The web-fed offset perfecting printing press of claim 8 wherein the blanket cylinder displacement means comprises:

(a) a drive shaft capable of bidirectional rotation; and (b) at least two articulated links connecting the drive shaft to one of the sleeves.

10. The web-fed offset perfecting printing press of claim 6 further comprising:

(a) a pair of frame walls;

(b) a plurality of sleeves rotatably mounted to each frame wall and each having a hole extending eccentrically therethrough; and (c) a pair of journals extending from opposite ends of each plate cylinder and each rotatably engaged in the eccentric hole of one of the sleeves;

(d) whereby each plate cylinder is moved between the image transfer and the image nontransfer positions with the bidirectional rotation of the associated pair of sleeves relative to the frame walls through a preassigned angle.

11. The web-fed offset perfecting printing press of claim 10 wherein the plate cylinder displacement means comprises:

(a) a plurality of drive shafts independently capable of bidirectional rotation; and (b) at least two articulated links connecting each drive shaft to one of the sleeves.

12. A web-fed offset rotary press comprising at least one printing unit for printing at least one side of a web of paper material, and folding means for folding the printed web, the folding means including a reference cylinder, wherein the reference cylinder is driven by a reference cylinder drive motor, the printing unit comprising:

(a) at least one blanket cylinder disposed at least on one side of a web traveling along a predefined path;

(b) blanket cylinder drive means for rotating the at least one blanket cylinder, wherein the blanket cylinder drive means comprises a single blanket cylinder drive motor for driving the at least one blanket cylinder;

(c) at least two plate cylinders disposed in circumferentially spaced positions of the blanket cylinder for offset printing different images on the web;

(d) plate cylinder drive means for individually rotating each plate cylinder, wherein the plate cylinder drive means comprises a plurality of plate cylinder drive motors each for driving one plate cylinder;

(e) displacement means for individually moving each plate cylinder between an image transfer position, where the plate cylinder is held to the at least one blanket cylinder in order to print an image thereon for subsequent transfer to the web, and an image nontransfer position wherein the plate cylinder is spaced from the at least one blanket cylinder; and (f) control means for causing the blanket cylinder drive means and the plate cylinder drive means to rotate the at least one blanket cylinder and each plate cylinder in predetermined phase relation with the reference cylinder included in the folding means, and for causing the displacement means to individually move the plate cylinders between the image transfer and the image nontransfer positions, wherein the control means comprises:

(1) modern control circuit means connected to each of the reference cylinder drive motor, the blanket cylinder drive motor and the plate cylinder drive motors for independently controlling the speed of rotation thereof, (2) phase signal means for producing a phase signal indicative of the rotational phase of the reference cylinder, the at least one blanket cylinder and each of the plate cylinders, (3) phase difference detector circuit means connected to the phase signal means for producing a phase difference signal indicative of a phase difference, if any, between the reference cylinder, the at least one blanket cylinder and each plate cylinder, the phase difference detector circuit means being connected to the modern control circuit means for causing the at least one blanket cylinder and each plate cylinder to rotate in predetermined phase relation with the reference cylinder, and (4) phase matching confirmation circuit means connected between the phase difference detector circuit means and the displacement means for each plate cylinder for permitting each plate cylinder to travel to the image transfer position only when that plate cylinder is rotating in phase with the at least one blanket cylinder;

(g) whereby a conversion from one image to another is possible without stopping the at least one blanket cylinder, as one plate cylinder is moved from the image transfer to the image nontransfer position and another plate cylinder is moved from the image nontransfer to the transfer position, with the at least one blanket cylinder and the plate cylinders held in rotation in predetermined phase relation with the reference cylinder and hence in phase with each other during such image conversion.

13. A web-fed offset rotary press comprising at least one printing unit for printing both sides of a web of paper material, and folding means for folding the printed web, the folding means including a reference cylinder, wherein the reference cylinder is driven by a reference cylinder drive motor, the printing unit comprising:

(a) two blanket cylinders disposed on opposite sides of a web traveling along a predefined path;

(b) blanket cylinder drive means for rotating the blanket cylinders at the same peripheral speed, wherein the blanket cylinder drive means comprises a single blanket cylinder drive motor for jointly driving both blanket cylinders;

(c) blanket cylinder displacement means for moving one blanket cylinder between a printing position, where said one blanket cylinder is held to the other blanket cylinder via the web for printing the same, and a nonprinting position where said one blanket cylinder is spaced from the other blanket cylinder;

(d) at least two plate cylinders disposed in circumferentially spaced positions of one blanket cylinder for offset printing different images on one side of the web;

(e) at least two other plate cylinders disposed in circumferentially spaced positions of the other blanket cylinder for offset printing different images on the other side of the web;

(f) plate cylinder drive means for individually rotating each plate cylinder, wherein the plate cylinder drive means comprises a plurality of plate cylinder drive motors each for driving one plate cylinder;

(g) plate cylinder displacement means for individually moving each plate cylinder between an image transfer position, where the plate cylinder is held against one blanket cylinder in order to print an image thereon for subsequent transfer to the web, and an image nontransfer position where the plate cylinder is spaced from the blanket cylinder; and (h) control means for causing the blanket cylinder drive means and the plate cylinder drive means to rotate the blanket cylinders and the plate cylinders in predetermined phase relation with the rotation of the reference cylinder included in the folding means, and for causing the plate cylinder displacement means to individually move the plate cylinders between the image transfer and the image nontransfer positions, wherein the control means comprises:

(1) modern control circuit means connected to each of the reference cylinder drive motor, the blanket cylinder drive motor and the plate cylinder drive motors for independently controlling the speed of rotation thereof, (2) phase signal means for producing a phase signal indicative of the rotational phase of the reference cylinder, the blanket cylinders and each of the plate cylinders, (3) phase difference detector circuit means connected to the phase signal means for producing a phase difference signal indicative of a phase difference, if any, between the reference cylinder, the blanket cylinders and each plate cylinder, the phase difference detector circuit means being connected to the modern control circuit means for causing the blanket cylinders and each plate cylinder to rotate in predetermined phase relation with the reference cylinder, and (4) phase matching confirmation circuit means connected between the phase difference detector circuit means and the blanket cylinder displacement means for permitting said one blanket cylinder to move from the nonprinting to the printing position only when said one blanket cylinder is rotating in predetermined phase relation with the reference cylinder, the phase matching confirmation circuit means being also connected between the phase difference detector circuit means and the plate cylinder displacement means for permitting each plate cylinder to travel to the image transfer position only when that plate cylinder is rotating in phase with the blanket cylinder;

(i) whereby a conversion from one image to another is possible on each side of the web without stopping the blanket cylinders and with said one blanket cylinder held in the printing position, as one plate cylinder is moved from the image transfer to the image nontransfer position and another plate cylinder is moved from the image nontransfer to the transfer position, with the blanket cylinders and the plate cylinders held in rotation in predetermined phase relation with the reference cylinder and hence in phase with each other during such image conversion.

14. The web-fed offset rotary press of claim 15 wherein the control means further comprises:

(a) a plate cylinder select circuit for selecting either of the two plate cylinders on each side of the web for printing, the plate select circuit means being connected to both the plate cylinder drive means and the plate cylinder displacement means; and (b) a delay circuit connected between the plate select cylinder circuit and the plate cylinder drive means for each plate cylinder in order to permit the drive means to decelerate and stop the associated plate cylinder after this cylinder has traveled from the image transfer to the nontransfer position.

15. The web-fed offset rotary press of claim 14 wherein the press comprises at least one other printing unit having at least one blanket cylinder and at least one plate cylinder, and wherein the control means include means for causing all the blanket cylinders and plate cylinders of all the printing units to rotate in predetermined phase relation with the reference cylinder.

* * * * *